United States Patent [19]

Moilanen

[11] Patent Number: 4,840,545

[45] Date of Patent: Jun. 20, 1989

[54] SCROLL COMPRESSOR RELIEF VALVE

[75] Inventor: John R. Moilanen, La Crescent, Minn.

[73] Assignee: American Standard Inc., New York, N.Y.

[21] Appl. No.: 194,271

[22] Filed: May 16, 1988

[51] Int. Cl.[4] ..... F04B 49/02

[52] U.S. Cl. ..... 417/301; 417/310

[58] Field of Search..... 417/301, 310, 291, 440; 418/55 R, 180

[56] References Cited

U.S. PATENT DOCUMENTS

| | | | |
|---|---|---|---|
| 4,216,661 | 8/1980 | Tojo et al. | 418/55 R |
| 4,383,805 | 5/1983 | Teegarden et al. | 418/55 R |
| 4,389,171 | 6/1983 | Eber et al. | 418/55 R |
| 4,560,330 | 12/1985 | Murayama et al. | 418/55 |
| 4,744,733 | 5/1988 | Terauchi et al. | 417/440 |

FOREIGN PATENT DOCUMENTS

| | | | |
|---|---|---|---|
| 3739978 | 1/1988 | Fed. Rep. of Germany | 417/310 |
| 0023589 | 1/1987 | Japan | 418/55 R |

*Primary Examiner*—Carlton R. Croyle

*Assistant Examiner*—Leonard P. Walnoha

*Attorney, Agent, or Firm*—William J. Beres; David L. Polsley

[57] ABSTRACT

In a rotary compressor, a relief valve for providing refrigerant at suction gas pressure to the discharg port when the rotary compressor is operated in the reverse rotation direction. The relief valve includes in the preferred embodiment a passage for providing a source of refrigerant at suction gas pressure to the discharge port relief valve, and a passage for providing refrigerant at suction pressure from the relief valve to the discharge port. When the compressor system is operated in the correct rotation, refrigerant at discharge pressure maintains the relief valve in the closed position, preventing flow from the discharge port to the suction pressure source. When the compressor system is operated in the reverse rotation however, the pressure in the discharge port is reduced to below that of the refrigerant in the suction pressure source, whereupon the releif valve opens permitting flow from the suction pressure source to the discharge port. This thereby provides a source of refrigerant to the compressor to prevent damage to the compressor system during the reverse rotation period.

20 Claims, 3 Drawing Sheets

FIG. 3
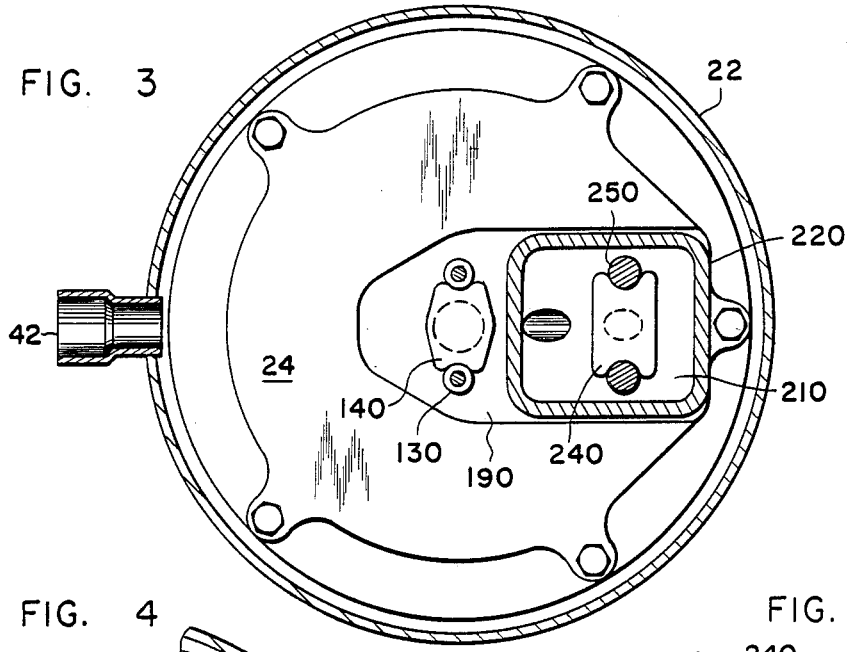
FIG. 4
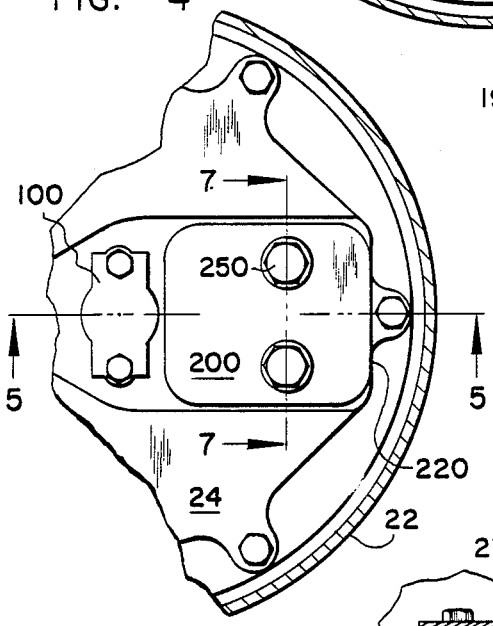
FIG. 5
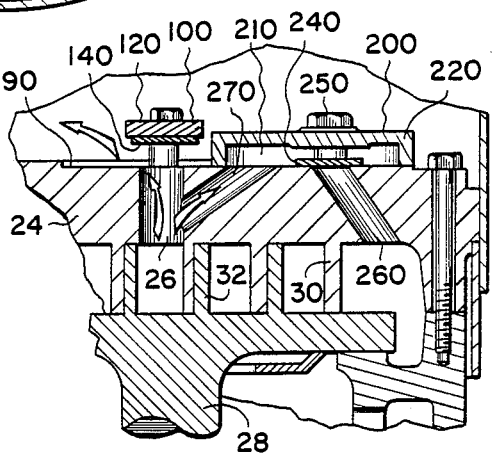
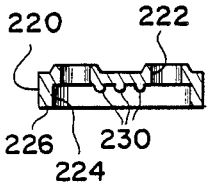
FIG. 7
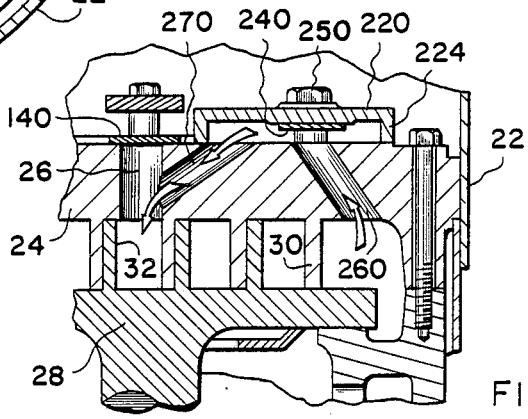
FIG. 6

FIG. 8
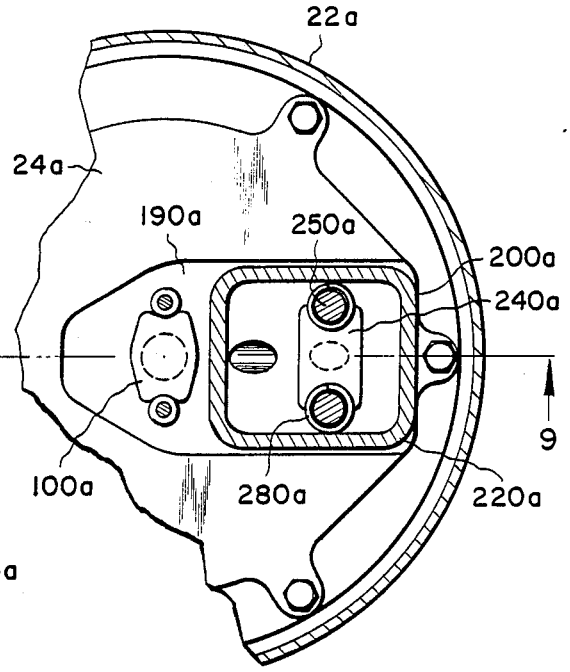
FIG. 11
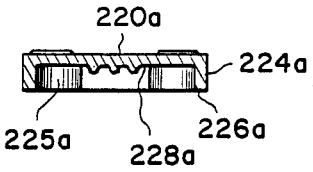
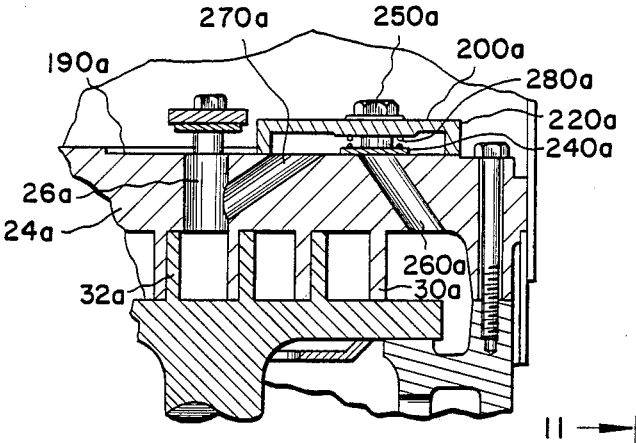
FIG. 9
FIG. 10
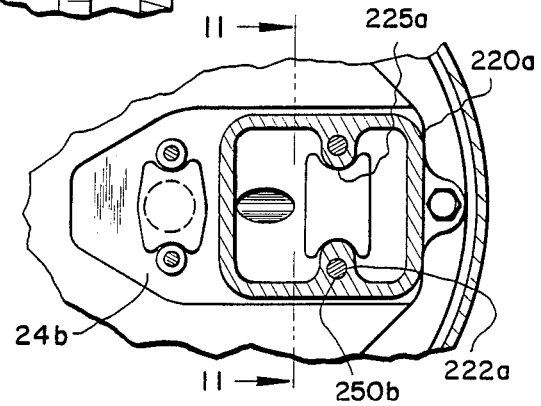

SCROLL COMPRESSOR RELIEF VALVE

DESCRIPTION

1. Technical Field

This invention generally relates to rotary compressors and specifically to relief valves for providing refrigerant to prevent damage during reverse rotation of rotary compressors.

2. Background Art

The typical rotary hermetic compressor is configured as typically one of two types. One type is the high side compressor and the other type is the low side compressor. This means simply that the motor which operates the compression portion of the system is disposed in the discharge or high-pressure portion of the hermetic shell, hence being a high-side compressor or that the motor is disposed in the suction or low pressure portion of the hermetic shell, thus being known as a low-side compressor. A common problem with the rotary compressor is the tendency of compressed refrigerant to flow from the discharge portion of the hermetic shell through the compression portion of the compressor system to the suction side of the hermetic shell and hence to repressurize the low-side of the system. This tendency may be eliminated by preventing reverse rotation of the compression portion of the system so that refrigerant may not pass through the compressor to the low-side portion of the hermetic shell.

This is typically accomplished by the inclusion in the compressor system of a check valve such as a reed valve or ball valve to prevent reverse flow of the refrigerant. It is also possible to accomplishe this by the inclusion of a solenoid operated shutoff valve in the refrigerant system to which the compressor is connected.

In a refrigeration system having a compressor which is protected from reverse rotation by a check valve, a separate additional problem arises in the event that the compressor is operated in reverse rotation for some reason such as improper wiring of the driving motor. This problem was recognized in U.S. Pat. No. 4,560,330, directed toward the high side compressor. In the high side compressor, a suction line check valve was included to prevent reverse rotation of the compressor due to pressure differential between discharge and suction line pressure, however, in the event of driven reverse rotation, discharge pressure refrigerant would be pumped from the discharge port to the suction line valve. This results in excessively high pressure tending to breakdown the exterior portion of the wraps in the scroll compressor described in the patent. The solution lay in providing a check valve to release this abnormally high pressure refrigerant to the discharge pressure portion of the hermetic shell.

It is impractical to apply the type of relief valve used in a high-side compressor to a low-side compressor. For example, if the check valve were placed on the suction line of the low-side compressor, refrigerant gas at discharge pressure would fill the entire hermetic shell upon each cessation of compressor operation, due to reverse rotation of the compressor elements. This would require that the entire hermetic shell, including that portion normally at suction pressure, be constructed to withstand discharge pressure refrigerant. This would require an unnecessarily heavy and expansive hermetic shell. Furthermore, in the event of intentional or accidental reverse rotation by reverse action of the motor, the entire hermetic shell could be subject to refrigerant at pressure equal to or exceeding the normal discharge pressure of the refrigerant. This could result in a bursting of the hermetic shell, with possible attendant injury and expense, or alternatively, the necessity of providing an unduly heavy and expensive hermetic shell. Finally, this design would necessitate the pumping down by the compressor of the entire suction portion of the hermetic shell to suction pressure before the check valve would open to admit refrigerant from the suction line, resulting in an unnecessary period of recompression of refrigerant at the beginning of each cycle of operation. This would adversely affect the efficiency of the system, introducing unnecessary time lag into the system response to demand for cooling and an unnecessary cost for recompressing the refrigerant.

Therefore, it is an object of this invention to provide a relief valve for preventing damage to a rotary compressor in reverse rotation.

It is another object of this invention to provide such a relief valve in a low-side compressor.

It is a still further object of the invention to provide such a relief valve as will permit the most economical operation of a low-side compressor.

It is a still further object of the invention to provide such a reverse rotation relief valve as will permit the lightest and most inexpensive construction of a low-side compressor.

It is yet another object of the invention to provide such a relief valve which is simple and economical in assembly, maintenance, and operation.

These and other objects of the invention will be apparent from the attached drawings and the Description of the Preferred Embodiment that follows hereinbelow.

SUMMARY OF THE INVENTION

The subject invention is a relief valve for a low-side rotary compressor which comprises a means for providing refrigerant at suction pressure to the discharge port of the compressor when the compressor is operated in reverse rotation. This is accomplished by the provision of a relief passage having a pressure responsive relief valve installed therein. This relief passage, in the preferred embodiment, is comprised of a body defining a chamber with a first passage extending from the chamber to a source of refrigerant at suction pressure and a second, intermediate passage extending from the chamber to the discharge port. A detached valve element operates within the chamber to cover and close the first passage when discharge pressure refrigerant enters the chamber by way of the intermediate passage and opens to permit the flow of suction pressure refrigerant into the chamber and through the intermediate passage when the pressure differential between the refrigerant in the suction pressure portion exceeds that of the refrigerant in the discharge port. This condition occurs when the compressor is operated in reverse, as the discharge check valve is then closed and the pressure of refrigerant in the discharge port becomes substantially low. In this condition, the relief valve of the subject invention provides oil-entraining refrigerant at suction pressure so that the compressor elements are not deprived of lubrication or the cooling effect of the refrigerant passing therethrough.

BRIEF DESCRIPTION OF THE DRAWINGS

FIG. 3 shows a cross-sectional view of the compressor of FIG. 2 taken along section line 3—3.

FIG. 4 shows a partial cross-sectional view of the compressor of FIG. 2.

FIG. 5 shows a partial cross-sectional view of the subject invention during normal operation of the compressor as taken along section line 5—5 of FIG. 4.

FIG. 6 shows the relief valve of the subject invention during reverse-rotation of the compressor as taken along section line 5—5 of FIG. 4.

FIG. 7 shows a cross-sectional view of the valve housing of the subject invention as taken through section line 7—7 of FIG. 4.

FIG. 8 shows a cross-sectional view of an alternative embodiment of the subject invention in the compressor of FIG. 2 taken along section line 3—3.

FIG. 9 shows a partial cross-sectional view of the alternative embodiment as taken along section line 9—9 of FIG. 8.

FIG. 10 shows a cross-sectional view of yet another embodiment of the subject invention in the compressor of FIG.2 taken along section line 3—3.

FIG. 11 shows a cross-sectional view of the valve housing of FIG. 10 taken along section line 11—11.

DESCRIPTION OF THE PREFERRED EMBODIMENT

Figure 1:
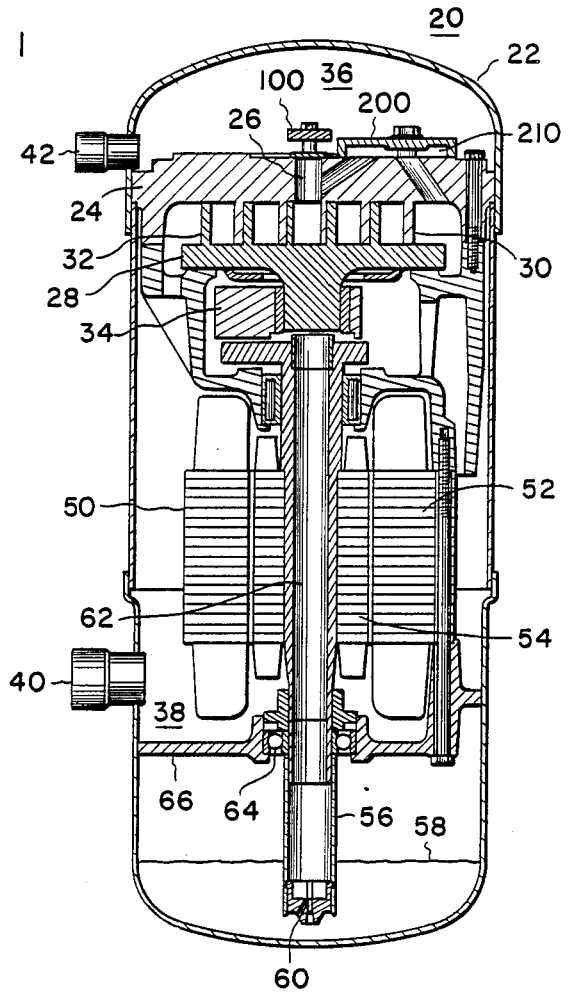
FIG. 1 shows a cross-sectional view of a low-side scroll compressor including the preferred embodiment of the subject invention.
Figure 2:
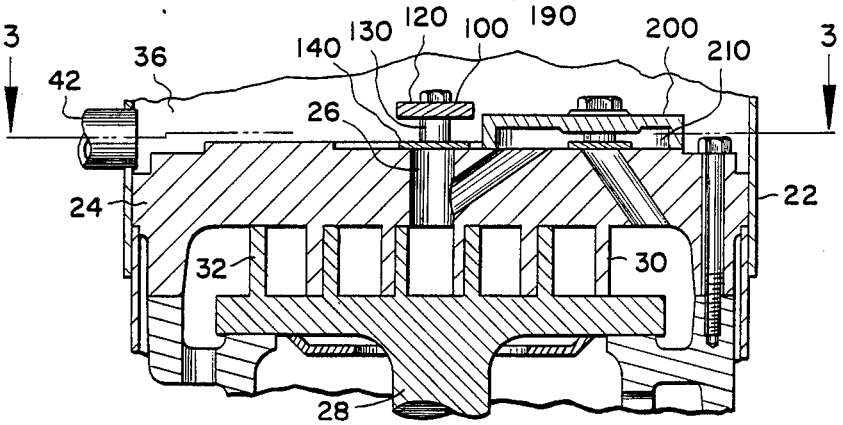
FIG. 2 shows an enlarged partial cross-sectional view of the compressor portion of the compressor of FIG. 1.

A refrigerant compressor system generally denoted by reference numeral 20 is shown in FIG. 1. Refrigerant compressor system 20 is a rotary compressor housed in a hermetic shell 22. The refrigerant compressor system 20 is not shown in FIG. 1 in detail since details regarding the compressor need not be disclosed to understand the form and function of the subject invention. In actual application of the subject invention, a scroll-type refrigerant compressor system is used. It is understood that a rolling piston or other rotary compressor would be equally suitable for application of the subject invention.

Reference may be had to U.S. Pat. Nos. 801,182; 3,924,977; 4,082,484 and 4,415,318, for a more complete discussion of the scroll-type fluid apparatus, its principles of operation and particulars of construction.

Disposed within the hermetic shell 22 is a fixed scroll 24 having a centrally located aperture defining a discharge port 26. An orbiting scroll 28 is disposed in a parallel spaced relationship with respect to the fixed scroll 24. A fixed involute wrap 30 is disposed on the fixed scroll 24, and an orbiting involute wrap 32 is disposed on the orbiting scroll 28 such that the respective involute wraps are in interleaving engagement definig a plurality of pockets having volume decreasing toward the center of the respective wraps. A swing-link mechanism 34 provides for compliant orbital non-rotating motion of the orbiting scroll 28.

The fixed scroll member 24 further serves to divide the hermetic shell 22 into a discharge pressure portion 36 and a suction pressure portion 38. It is to be understood that the division of the hermetic shell 22 into the discharge pressure portion 36 and the suction pressure portion 38 could be accomplished in the rotary compressor by other means such as an independent barrier member, and that the use of the fixed scroll member 24 is not to be taken as limiting. A suction port 40 is provided to admit suction pressure refrigerant to the suction pressure portion 38 of the hermetic shell 22, and a discharge port 42 is provided to remove discharge pressure refrigerant from the discharge pressure portion 36 of the hermetic shell 22

The refrigerant compressor system 20 is driven by an internal electric motor 50 disposed within the suction pressure portion 38 of the hermetic shell 22. The electric motor 50 includes a stator 52 and a rotor 54. A drive shaft 56 passes through the rotor 54, with its lower end extending into a reservoir of oil 58. Disposed at the lower distal end of the drive shaft 56 is a centrifugal oil pump 60 operative to cause oil 58 to flow upward through an internal bore 62 within the drive shaft 56. The oil thus forced upward through the internal bore 62 lubricates surfaces subject to friction within the compressor system 20 such as the lower drive shaft main bearing 64. The drive shaft bearing 64 is supported in a framework 66 which is attached to the hermetic shell 22 and includes other bearings and structure necessary to support the orbiting scroll member 28. The oil pump 60, motor 50, components of the motor 50 and the structures for supporting the motor 50 are not disclosed in detail, as they are believed to be generally understood in the art. It is understood, for example, that oil pump 60 would be equally suitable if a gear-type or similar pump were used.

The refrigerant compressor assembly 20 further includes means for preventing a backflow of refrigerant from the discharge pressure portion 36 into the discharge port 26 when the pressure of refrigerant in the discharge pressure portion 36 exceeds the ressure of refrigerant in the discharge port 26 Perferably this is accomplished by a compressor discharge valve assembly 100, which is generally shown disposed atop the fixed scroll member 24 adjacent the discharge port 26. This discharge valve assembly 100 may be a ball-type valve, a pressure relief valve, or other suitable valve.

Preferably, the discharge valve assembly 100 is comprised of a valve stop member 120, two guide collars 130, and a detached valve element 140 operating between a closed position and an open position. In the open position, the valve element 140 rests against the valve stop member 120, thus permitting refrigerant to flow from the discharge port 26 to the discharge pressure portion 36 of the hermetic shell, while in a closed position the valve element 140 coveringly seals the discharge port 26 to prevent a flow of refrigerant from the discharge pressure portion 36 into the discharge port 26. As will be described more fully herein, the valve element 140 assumes the closed position under either of two conditions, the first being the inoperative stae of the compressor, and the second being the reverse rotation operation of the compressor.

A relief valve assembly 200 as in the preferred embodiment of the subject invention is shown disposed on the upper surface 190 of the fixed scroll member 24. The relief valve assembly 200 is comprised of a valve containment member or relief housing 220 and a relief valve element 240. The housing 220 cooperates with the upper surface 190 to define a relief chamber 210 wherein the relief valve element 240 operates to freely move between an open position and a closed position in response to any pressure differential acting upon the valve element 240.

A bore having a first end disposed in the suction pressure portion 38 of the hermetic shell 22 and a second end disposed in the relief chamber 210 defined by housing 220 and upper surface 190 constitutes a first, suction pressure source passage, 260 enabling a flow of refrigerant from the suction pressure portion 38 to the relief chamber 210. A second, intermediate refrigerant flow passage 270 is defined by a bore having a first end in the relief chamber 210 defined by the relief housing 220 and upper surface 190, and a second end flowably intersecting the aperture defining the discharge port 26 of the fised scroll member 24.

The relief housing 220 is secured to the fixed scroll member 24 in the preferred embodiment by two guide bolts 250 which extend through suitable guide bolt apertures 222 in the relief housing 220. The preferred location of the guide bolts 250 is most readily apparent in FIGS. 3 and 4. The guide bolts 250 are disposed at opposite sides of the relief housing 220 to accommodate the relief valve element 240 therebetween, thereby serving the dual purpose of guiding the relief valve element 240 between the open and closed position while simultaneously positionally securing the relief housing 220. The guide bolts 250 limit the travel of the relief valve element 240 to prevent misalignment and ensure proper sealing of the relief valve element 240 over the aperture in the upper surface 190 defining the second end of the suction pressure source passage.

In the preferred embodiment, the guide bolts 250 include smooth guide portions and threaded end portions extending into suitable threaded apertures (not shown) in the fixed scroll member 24. It will be apparent to those skilled in the art that the relief housing 220 may be secured to the upper surface 190 by such means as welding and, likewise, that the guide bolt holes 222 could be threaded to accommodate a mating threaded portion of the guide bolts 250, and that it would not be necessary to provide apertures in the fixed scroll member 24 in alternative embodiments.

The relief housing 220, as generally shown in FIGS. 1–7, is comprised of a generally rectilinear body with a downwardly extending wall portion 224 extending about the terminal end of the housing 220. The wall portion 224 extends to a wall end 226 which is planar for sealing engagement with the planar upper surface 190. In the preferred embodiment, no separate seal is required between the housing 220 and the upper surface 190, however, it will be apparent to those skilled in the art that a suitable elastomer seal or a sealing material such as a suitable caulk could be disposed therebetween to further enhance the sealing effect if desired.

A cavity which when the housing 220 is secured by bolts 250 to the upper surface 190 comprises the relief chamber 210, is defined withing the relief housing 220 by a generally planar inner surface 228 and the downwardly extending wall 226. The inner surface 228 is generally parallel to the upper surface 190 of the fixed scroll member 24, and includes a plurality of relief valve engaging protuberances 230. The protuberances 230 serve to stop the relief valve element 240 in the open position. In the preferred embodiment, there are three such protuberances 230 in parallel disposition, each such protuberance 230 being rectilinear in shape. Although these protuberances 230 are shown perpendicularly disposed with respect to the long access of the relief valve element 240, they could equally well be disposed in parallel orientation with respect to this axis. Futhermore, these protuberances 230 need not be rectilinear in shape, but may be downwardly extending dimples of hemispheric or conical shape.

The relief valve element 240 preferably is a substantially thin, planar element having oppositely disposed ends 244, each comprised of two hemispheric lobes 245 with an arcuate portion 246 of a circle defined therebetween for closely fitting about the guide bolt 250. The radius of the arcuate portion 246 of the end 244 is sized to provide a clearance of several thousandths of one inch between the valve element 240 and the guide bolts 250, for free movement of the relief valve element 240. The dispostion of the valve element 240 in the relief valve assembly 200 is depicted in FIGS. 2 through 6.

In operation, the electric motor 50 is energized causing the rotor 54 and the drive shaft 56 to rotate. This rotation is translated by the swing-link mechanism 34 to cause orbital non-rotating movement of the orbiting scroll member 28 with respect to the fixed scroll member 24. The interleaving fixed involute wrap 30 and orbiting involute wrap 32 thus generate a plurality of pockets of decreasing volume from the radially outer ends of the respective wraps toward the center of the respective wraps.

During the operation of the electric motor 50, refrigerant gas is drawn into the suction pressure portion 38 through the suction port 40 from the refrigeration system (not shown). The refrigerant gas then circulates through the components of the electric motor 50 and entrains in the refrigerant gas flow a portion of the oil in the reservoir of oil 58. The oil entraining refrigerant is then compressed in the plurality of pockets defined by the interleaving wraps of the respective scrolls and ejected through the discharge port 26. The ejected oil entraining refrigerant gas forces the valve element 140 to the open position, permitting the now discharge pressure refrigerant to be exhausted to the discharge pressure portion 36 and returned to the refrigeration system through the discharge port 42.

A portion of the discharge pressure refrigerant enters the second, intermediate passage 270 and flows therethrough to fill the relief chamber 210 defined in the relief housing 220 with refrigerant at discharge pressure. As the refrigerant in the first passage 260 is at suction pressure, the relief valve element 240 is forced by the weight of gravity and the pressure differential between the discharge pressure refrigerant and the suction pressure refrigerant to the closed position. In this position, the relief valve element 240 sealingly covers the first passage 260, preventing flow of refrigerant therethrough.

Upon de-energization of the electric motor 50, the valve element 140 immediately moves to a closed position, whereby the valve element is disposed about the discharge port 26 in a covering, sealing manner. This prevents a backflow of refrigerant from the discharge pressure portion 36 into the discharge port 26. The discharge pressure refrigerant may force some slight reverse rotation of the orbiting scroll member 28 until the refrigerant pressure in the discharge port 26, second intermediate passage 270 and relief chamber 210 in the housing 220 is reduced to a point where it is insufficient to cause reverse rotation, however, the volume of refrigerant therein is substantially small. In this state, both the valve element 140 and the relief valve element 240 remain in the closed positions due to the action of the pressure differential upon the respective valve elements in combination with the action of gravity upon the valve element mass.

In the event of accidental or intentional reverse rotation of the orbiting scroll member 28 with respect to the fixed scroll member 24, the fixed wrap 30 and the orbiting wrap 32 function as expanders, removing refrigerant from the discharge port 26. The pressure of refrigerant in the discharge port 26 is reduced below that of refrigerant at suction pressure, and refrigerant is drawn from the second, intermediate passage 270 and the relief chamber 210. As the refrigerant is withdrawn therefrom, the pressure of refrigerant in the relief housing 220 is reduced below that of the refrigerant at suction pressure. The pressure of refrigerant in the first passage 260 then exceeds that of the refrigerant in the relief chamber 210, thereby forcing the relief valve element 240 to the open position along the guide bolts 250 to engage the protuberances 230. The refrigerant thus entering the relief chamber 210 in the housing 220 from the first passage 260 flows through the housing 220 and the second intermediate passage 270 into the discharge port 26, supplying refrigerant to the scroll wraps 30 and 32. This oil entrained refrigerant provides lubrication to the wraps to prevent damage due to lack of lubrication, in addition to providing a source of refrigerant to prevent breakdown of the wraps 30 and 32 due to excessively low pressure at the inner ends thereof.

An alternative embodiment of the relief valve assembly **200*a* is shown in FIGS. 8 and 9, disposed on the upper surface 190*a* of the fixed scroll member 24*a*. As in the preferred embodiment, the relief valve assembly 200*a* is comprised of a housing 220*a* cooperating with the upper surface 190*a* to define a relief chamber wherein a relief valve element 240*a* operates between an open and a closed position. The relief housing 220*a* is secured to the fixed scroll 24*a* by two guide bolts 250*a* which extend through suitable guide bolt apertures 222*a* in the relief housing 220*a*. Two coil springs 280*a* are disposed in the relief housing 220*a*, each spring 280*a* being coaxially disposed about a respective guide bolt 250*a* between the relief valve element 240*a* and the relief housing 220*a*. Alternatively, a leaf spring 280*a* or a single coil spring 280*a* mat be disposed between the guide bolts 250*a*. The springs 280*a* acts to bias the relief valve element 240*a* to the closed position. Preferably, the springs 280*a* have a small spring constant k to provide a minimal biasing force while causing the relief valve element 240*a*** to move rapidly to the closed position in response to changes in the refrigerant pressures.

In operation, this alternative embodiment is similiar to that of the preferred embodiment, however, the springs **280*a* cause the relief valve element 240*a* to remain in or return to the closed position whenever the refrigerant pressure in the discharge port 26*a* in combination with the pressure by the spring 280*a* on the relief valve element 240*a*** exceeds the refrigerant suction pressure.

In another alternative embodiment shown in FIGS. 10 and 11, the relief housing **220*b* includes integral guide portions 225*b* disposed in the relief chamber. The guide portions 225*b* are integral with the downwardly extending wall 244*b*, being coplanar with the wall end surface 226*b*, and with the inner surface 228*b*. Preferably, the guide portions 225*b* are semi-cylindric, having an axis parallel to the axis of guide bolt holes 222*b* extending through the relief housing 220*b*. This alternative embodiment is, in operation, identical to the preferred embodiment. However, this alternative embodiment does not require the use of guide bolts 250*b*, but may use standard threaded bolts or may be secured by welding epoxy to the fixed scroll member 24*b***, and hence may be more economical of manufacture in large quantities.

Preferably, the components of the relief valve assembly 200 are formed of suitable steel alloy. While it is possible that the relief housing 220 may be a machined component in its entirety, the housing 220 is preferably forged, cast, or formed from powdered metal and the guide holes 222 and the wall end 226 machined by drilling or milling, as appropriate. The relief valve element 240 is preferably formed by die-press operations, although the relief valve element 240 may be formed by casting or forging if desired.

Additionally, in the preferred embodiment, the first passage 260 is formed at an angle of 55° from the vertical and the second passage 270 is formed at an angle of 37° from the vertical. It is readily apparent that these angles may be changed within a reasonable range, provided only that the ends of the respective passages are disposed to accomplishe the proper flow.

The subject invention provides a simple and inexpensive means for preventing damage to the compressor when operated in reverse rotation either accidentally or intentionally. Furthermore, the subject invention offers the advantage of requiring little or no adjustment or maintenance. Additionally, the subject invention in its preferred embodiment is virtually immune to failure due to fatigue, as there are no elastomeric or other components required to flex or bend and thus fatigue. Finally, the subject invention adds little weight to the compressor system and is not detrimental to the operating efficiency of the compressor system.

Modifications to the preferred embodiment of the subject invention will be apparent to those skilled in the art within the scope of the claims that follow herein.

What is claimed is:

1. A scroll compressor reverse-rotation relief valve for a hermetic compressor operating to compress a refrigerant, said relief valve comprised of:

a scroll compressor element disposed in said hermetic compressor to divide said scroll compressor into a suction pressure portion and a discharge pressure portion, said scroll compressor element having a discharge port defined therethrough to discharge refrigerant into said discharge pressure portion, said scroll compressor element further including a relief passage interconnecting a source of suction pressure refrigerant to said discharge port;

means for preventing a backflow of refrigerant from said discharge pressure portion into said discharge port;

means for closing said relief passage in a flow preventing manner disposed in said relief passage, said relief passage closing means being refrigerant pressure responsive to selectively prevent a flow of refrigerant through said relief passage whereby said relief passage is closed by said relief passage closing means when the scroll compressor is operated with the correct rotation to produce refrigerant discharge pressure exceeding refrigerant suction pressure, and said relief passage is open to permit passage of suction pressure refrigerant to said discharge port when the scroll compressor is operated in reverse rotation to produce refrigerant discharge pressure less than refrigerant suction pressure.

2. A scroll compressor reverse-rotation relief valve as set forth in claim 1 wherein said relief passage closing means is further comprised of a refrigerant pressure responsive free-moving valve member having an open position and a closed position.

3. The scroll compressor reverse-rotation relief valve as set forth in claim 2 wherein said relief passage closing means is further comprised of means for biasing said valve member to the closed position.

4. The scroll compressor reverse-rotation relief valve as set forth in claim 2 wherein said hermetic scroll compressor is further comprised of a valve containment member disposed on said scroll compressor element for containing said valve member.

5. The scroll compressor reverse-rotation relief valve as set forth in claim 4 wherein said scroll compressor element further includes an intermediate passage between said discharge port and said valve containment member for refrigerant flow therethrough.

6. The scroll compressor reverse-rotation relief valve as set forth in claim 5 wherein said valve containment member further comprises a chamber for directing refrigerant from said relief passage to said intermediate passage whereby said refrigerant flows from said source of suction pressure refrigerant to said discharge port.

7. The scroll compressor reverse-rotation relief valve as set forth in claim 6 wherein said valve containment member includes means for limiting the travel of said valve member.

8. The scroll compressor reverse-rotation relief valve as set forth in claim 7 wherein said travel limiting means is further comprised of means for guiding said valve member between said open position and said closed position and means for stopping said valve member in said open position.

9. A scroll compressor reverse-rotation relief valve for a hermetic scroll compressor operating to compress a refrigerant, said relief valve comprised of:

a scroll compressor element disposed in said hermetic scroll compressor to divide said hermetic scroll compressor into a suction pressure portion and a discharge pressure portion, said scroll compressor element having a discharge port defined therethrough for directing refrigerant at discharge pressure to the discharge pressure portion, said scroll compressor element further including a relief passage for interconnecting said suction pressure portion to said discharge port, said relief valve having an inlet in said suction pressure portion;

means for preventing a back flow of refrigerant into said discharge port from said discharge pressure portion;

means for closing said relief passage in a flow preventing manner to prevent flow of refrigerant from said discharge port ot said suction pressure portion, said relief passage closing means including a pressure responsive, free-moving valve member having an open, flow-permitting position and a closed, flow-preventing position whereby said relief passage is closed by said relief passage closing means when the scroll compressor is operated with correct rotation to produce refrigerant discharge pressure exceeding refrigerant suction pressure, and said relief passage is open to permit passage of suction pressure refrigerant to said discharge port when the scroll compressor is operated in reverse rotation to produce refrigerant discharge pressure less than refrigerant suction pressure.

10. The scroll compressor reverse-rotation relief valve as set forth in claim 9 wherein said hermetic scroll compressor is further comprised of a valve containment member disposed on said scroll compressor element, said valve containment member defining a chamber therein for containing said valve member.

11. The scroll compressor reverse-rotation relief valve as set forth in claim 10 wherein said scroll compressor element further includes an intermediate passage between said discharge port and said valve containment member for refrigerant flow therethrough.

12. The scroll compressor reverse-rotation relief valve as set forth in claim 11 wherein said valve containment member cooperates with a surface of said scroll compressor element to enclose said chamber for directing refrigerant from said relief passage to said intermediate passage when said valve member is in the open position.

13. The scroll compressor reverse-rotation relief valve as set forth in claim 12 wherein said valve containment member includes means for limiting the travel of said valve member.

14. The scroll compressor reverse-rotation relief valve as set forth in claim 13 wherein said travel limiting means is further comprised of means for guiding said valve member between said open position and said closed position, and means for stopping said valve member in said open position.

15. A scroll compressor reverse-rotation relief valve for a hermetic scroll compressor operating to compress a refrigerant, said relief valve comprised of:

a scroll compressor element disposed in said hermetic scroll compressor, said scroll compressor element having a surface dividing said scroll compressor into a suction pressure portion and a discharge pressure portion, said scroll compressor element further having a discharge port defined therethrough to discharge refrigerant into said discharge pressure portion, said scroll compressor element further including a relief passage defined through said scroll compressor element, said relief passage having an inlet in said suction pressure portion, said scroll compressor element further including an intermediate passage defined through said scroll compressor element from said discharge port to said scroll compressor element surface;

means for preventing a back flow of refrigerant from said discharge pressure portion into said discharge port, said back flow preventing means disposed on said scroll compressor element surface in said discharge pressure portion;

a refrigerant pressure responsive, free-moving valve member having an open, flow permitting position and a closed, flow-preventing position for contacting said scroll compressor element surface to prevent refrigerant flow through said relief passage in said closed position;

a valve containment member cooperating with said scroll compressor element surface to define an enclosed chamber for containing said valve member, said valve containment member further cooperating with said valve compressor element surface to define a chamber for directing refrigerant from said relief passage to said intermediate passage when said valve member is in the open position;

means disposed in said valve containment member for guiding said valve member between the open position and the closed position.

16. A hermetic scroll compressor having a reverse-rotation relief valve, said hermetic scroll compressor comprised of:

a first scroll compressor element disposed in said hermetic scroll compressor to divide said scroll compressor into a suction pressure portion and a discharge pressure portion, said scroll compressor element having a discharge port defined therethrough for directing refrigerant to the discharge pressure portion, said scroll compressor element further including a relief passage having an inlet in said suction pressure portion, said scroll compressor element further defining an intermediate passage having an outlet in said discharge port, said scroll compressor element further having a first, upstanding involute wrap disposed thereon;

a second scroll compressor element disposed in said hermetic scroll compressor for orbital non-rotating movement with respect to said first scroll compressor element, said second scroll compressor element having a second upstanding vortical wrap disposed thereon for interleaving engagement with said first upstanding vortical wrap;

means for driving said second scroll compressor element disposed in said hermetic scroll compressor, said driving means disposed in said suction pressure portion;

means for preventing a back flow of refrigerant into said discharge port from said discharge pressure portion means for closing said relief passage in a flow preventing manner to prevent flow of refrigerant from said discharge port to said suction pressure portion, said relief passage closing means including a pressure responsive, free-moving valve member having an open, flow-permitting position and a closed, flow-preventing position whereby said relief passage is closed by said relief passage closing means when the scroll compressor is operated with correct rotation to produce refrigerant discharge pressure exceeding refrigerant suction pressure, and said relief passage is open to permit passage of suction pressure refrigerant to said discharge port when the scroll compressor is operated in reverse rotation to produce refrigerant discharge pressure less than refrigerant suction pressure.

17. The scroll compressor as set forth in claim 16 wherein said scroll compressor is further comprised of a valve containment member disposed on said first scroll compressor element, said valve containment member defining a chamber therein for containing said valve member.

18. The scroll compressor as set forth in claim 17 wherein said valve containment member cooperates with a surface of said first scroll compressor element to enclose said chamber for directing refrigerant from said relief passage to said intermediate passage when said valve member is in the open position.

19. The scroll compressor as set forth in claim 18 wherein said valve containment member includes means for limiting the travel of said valve member.

20. The scroll compressor as set forth in claim 19 wherein said travel limiting means is further comprised of:

means for guiding said valve member between said open position and said closed position, and means for stopping said valve member in said open position.

* * * * *

UNITED STATES PATENT AND TRADEMARK OFFICE

CERTIFICATE OF CORRECTION

PATENT NO. : 4,840,545

DATED : June 20, 1989

INVENTOR(S) : John R. Moilanen

It is certified that error appears in the above-identified patent and that said Letters Patent is hereby corrected as shown below:

In the Abstract:

Line 2, "discharg" should be --discharge--.

Line 16, "releif" should be --relief--.

In the Specification:

Column 1, lines 65-66, "expansive" should be --expensive--.

Column 3, line 52, "definig" should be --defining--.

Column 4, line 29, "ressure" should be --pressure--.

Column 4, line 50, "stae" should be --state--.

Column 5, line 6, "fised" should be --fixed--.

Column 5, line 48, "withing" should be --within--.

Column 8, line 14, "accomplishe" should be --accomplish--.

In the Claims:

UNITED STATES PATENT AND TRADEMARK OFFICE

CERTIFICATE OF CORRECTION

PATENT NO. : 4,840,545

DATED : June 20, 1989

INVENTOR(S) : John R. Moilanen

It is certified that error appears in the above-identified patent and that said Letters Patent is hereby corrected as shown below:

Column 9, claim 9, line 49, "ot" should be --to--.

Signed and Sealed this

Thirteenth Day of March, 1990

*Attest:*

*Attesting Officer*

JEFFREY M. SAMUELS

*Acting Commissioner of Patents and Trademarks*